United States Patent [19]

Navlyt

[11] 4,117,792

[45] Oct. 3, 1978

[54] OVEREDGE STITCH FORMATION

[75] Inventor: Gerald S. Navlyt, Woodstock, Ill.

[73] Assignee: Union Special Corporation, Chicago, Ill.

[21] Appl. No.: 829,303

[22] Filed: Aug. 31, 1977

[51] Int. Cl.[2] ..... B32B 31/00; D05B 1/20

[52] U.S. Cl. ..... 112/433; 112/269

[58] Field of Search ..... 112/433, 269, 268, 199, 112/162, 177

[56] References Cited

U.S. PATENT DOCUMENTS

| | | | |
|---|---|---|---|
| 1,762,479 | 6/1930 | Maier | 112/162 X |
| 3,067,706 | 12/1962 | Armstead, Jr. | 112/433 |
| 3,431,876 | 3/1969 | Russell | 112/433 |

*Primary Examiner*—Peter Nerbun

*Attorney, Agent, or Firm*—John W. Harbst; John A. Schaerli

[57] ABSTRACT

This invention relates to a method and apparatus for forming an overedge stitch adapted to join a plurality of material workpieces along their edge. The overedge stitch of the present invention is formed with four threads. Two of the four threads are formed into material penetrating needle loops which project through the workpiece at spaced intervals. The first needle loop is interlooped at the lower point of penetration with the third or lower looper thread whereby uniting the workpieces. The looper thread, together with the second needle loop, is laterally spread beneath the lowermost workpiece to a point whereat they are interlooped with the fourth or upper looper thread. The loops of the upper looper thread shall be extended for subsequent penetration by one of the needle loops on the uppermost workpiece whereby forming an overedge stitch along the edge of the workpiece.

4 Claims, 9 Drawing Figures

OVEREDGE STITCH FORMATION

BACKGROUND OF THE INVENTION

This invention relates to an overedge stitch, and more particularly to an improved apparatus for, and method of forming an overedge stitch for joining a plurality of material workpieces, and an improved stitch formed thereby.

In the formation of some overedge stitch seams it has generally been the custom to feed two pieces of work material that are to be joined through the sewing machine in superimposed relation with the edges of the material positioned in vertical alignment. Two fabric penetrating loops are formed by passing a pair of thread carrying needles, positioned in a side by side relationship, through the workpiece at points lying along a first line extending parallel with the edge of the workpiece. The loops formed by the second needle penetrate the workpiece at points lying along a second line spaced a greater distance from the edge than the line of penetration points of the first needle. An element of the machine interloops a lower or looper thread through the two needle loops whereby securing the first and second thread loops in the garment. This third loop of thread is carried to the edge of the workpiece by said element and pierced by a subsequent thread loop, or upper looper thread. The upper looper thread is then passed over the upper surface of the top ply and pierced by a subsequent fabric penetrating loop. The completed seam finds the two plies of fabric in overlying relationship with the seam extending along a common edge of the two plies. The type of stitch produced by such a machine and described hereinabove is generally referred to as a Federal Stitch Type 512. However, this type of stitch has certain disadvantages when used on garments employing inferior grades of thread. That is, the tightness of the stitch, and more particularly the interlooping of the first and second needle thread loops with the third or looper thread causes pucker of the garment which in many instances may produce an undesirable and unacceptable garment. In addition to this, and as will become apparent hereinafter, there is only a single overedge thread protecting the edge of the garment whereas with the present invention a plurality of threads are employed to secure or cover the edge of the garment whereby resulting in a probability of a lesser chance for the edge of the fabric to ravel.

SUMMARY OF THE INVENTION

In accordance with the present invention there is provided an overedge stitch which serves the purpose of securing together two superimposed workpieces while at the same time covering the edges thereof. The stitch of the present invention is produced by employing two fabric penetrating thread carrying needles, which are positioned in a side by side relationship, for carrying a first and second continuous needle thread through the workpiece. The respective threads carried by said needles are formed into first and second needle thread loops which depend from the underside of the workpiece. A reciprocatory thread carrying looper means interloops a third or looper thread, with the first needle loop for securing the latter in the garment whereby uniting or joining the two superimposed fabric edges.

In the preferred embodiment, the eye portions of the needles are disposed in different horizontal planes. That is, the eye portion of the first needle is axially positioned closer to the point of the needle than is the position of the eye means of the second needle relative the point thereof. The staggered arrangement of the needle eyes is provided so that a thread manipulating inplement, moveable above but in relation to the looper means, is passed through the first needle loop but engages and distends the second needle loop along the bottom side of the fabric and carries same to the edge of the workpiece. In view of the first needle having an eye axially positioned closer to the needle point, the first needle thread loop depends from the garment a greater distance than does the second loop of needle thread. In this manner the looper and thread manipulating implement travel in a path through the lower depending loop but in view of the second needle thread loop being disposed closer to the garment coupled with the displacement of the implement relative the looper only the thread engaging implement engages and distends the second loop during its path of travel. An element of the machine, moveable in operative association with the looper and thread manipulating implement, pierces the second and third loops of thread and passes therethrough a fourth thread loop, or upper looper thread, which is effective to position the second and third thread loops along the edge of the workpiece whereby increasing the amount of thread coverage on the edge thereof than has been heretofore known. The fourth loop of thread or upper looper thread, is extended to the succeeding point of penetration of the second needle thread and is interlooped therewith whereby completing an overedge stitch.

From the above, it is apparent that the second needle thread loop is no longer secured to the underside of the fabric workpiece and only one needle thread loop is employed for joining or uniting the workpieces together. In this manner, less puckering of the garment workpieces occurs. The overedge stitch herein disclosed also adds elasticity to the seam formed by the present invention. An added advantage of the present invention is the provision of an extra thread loop positioned along the edge of the fabric workpiece whereby greatly increasing the coverage therealong.

In view of the above, a primary object of this invention is the provision of an overedge stitch which will join a plurality of workpieces and cover the edge of same with a pleasing appearance.

Another object of this invention is the provision of an overedge stitch which allows more coverage on the edge of the material thus further aiding in preventing ravelling of the workpiece.

Another object of this invention is the provision of an overedge stitch which provides for a relatively flat seam.

Yet another object of this invention is to form an overedge stitch which has more elasticity in the seam than that which has been heretofore known.

Another object of this invention is the provision of an improved overedge sewing machine capable of increasing the thread coverage of the edge of the workpiece.

Yet another object is to provide a method of forming an overedge stitch with increased edge coverage.

Further objects and advantages of this invention will become apparent from the description now to follow of the preferred embodiment thereof shown by way of example in the accompanying drawings in which.

DETAILED DESCRIPTION OF THE PREFERRED EMBODIMENT

Figure 1:
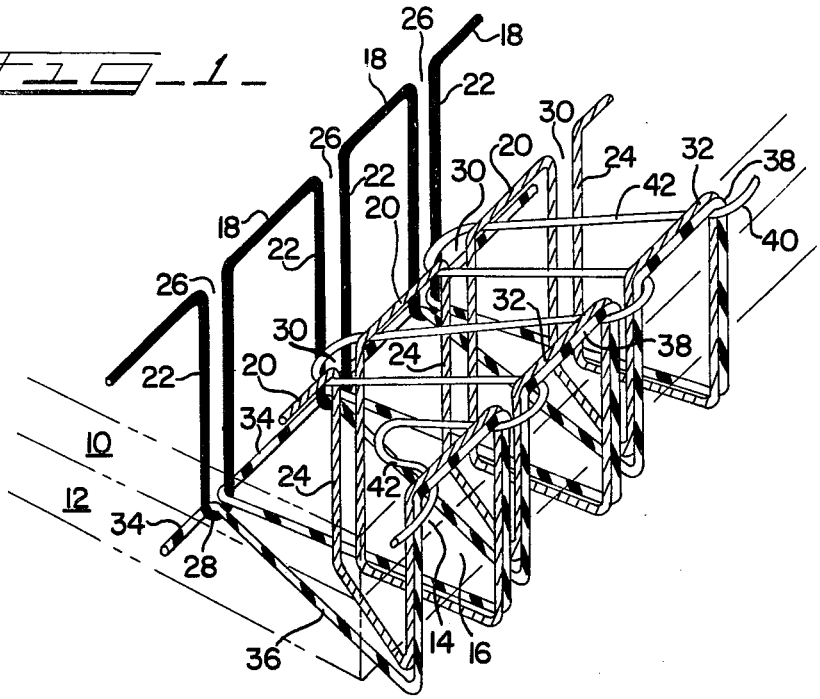
FIG. 1 represents a diagrammatic perspective view of the overedge stitch embodying the present invention with the stitch being illustrated as being formed in a workpiece as shown in phantom lines.

Referring to the drawings, in which like reference numerals indicate like parts throughout the several views, the stitch forming mechanisms of the present invention closely resemble the type employed in an overedge sewing machine such as that which forms the subject matter of U.S. Pat. No. 2,704,042 issued Mar. 15, 1955 to N. L. Wallenberg, et al. and which is incorporated herein by reference. The stitch of the present invention is produced on a Class 39500QW machine manufactured by Union Special Corporation and which is constructed in accordance with the principles disclosed in the above referenced patent. However, the showing of only certain key elements of the machine will be specifically referred to.

Referring now more particularly to FIG. 1, during the formation of the stitch, the two plies of workpieces to be joined are fed through the machine in the relationship shown wherein the uppermost ply of work material 10 is located with its edge 14 superimposing the corresponding edge 16 of the lower ply 12. The major portions of both plies of workpieces 10 and 12 are located upon the same side of the edges to be joined. The stitch formation may be applied to plies of fabric having a wide width, that is extending to the left as viewed in FIG. 1, which is not limited by dimensions of the sewing machine.

The overedge stitch shown in FIG. 1 is comprised of a pair of continuous upper or needle threads 18 and 20 which are formed into first and second thread loop 22 and 24 which lie along a line parallel to and laterally offset from the edges of the workpieces 10 and 12 to be joined. The first loop of thread 22 passes downwardly from its penetration point 26 through both workpieces 10 and 12 and extends downwardly to locate the bight portion 28 of the loop 22 beneath the penetration joint 26. The second loop of thread 24 passes downwardly from its penetration point 30 through both workpieces 10 and 12 and is extended outwardly and upwardly to locate the bight portion 32 of each loop 24 adjacent the edge 14 of the uppermost workpiece 10. A lower or looper thread 34 is formed into a third loop of thread 36. The looper thread 34 passes through the bight portion 28 of the first thread loop 22 and around the laterally aligned second thread loop 24. The bight portion 38 of each loop 36 of the lower thread 34 is extended to a point contiguous with the bight portion 32 of the second thread loop 24. In so doing, the bight portions 32 and 38 of loops 24 and 36, respectively, are disposed along the edge 14 and 16 of the workpieces 10 and 12. An upper or looper thread 40 is formed into a fourth thread loop 42. The fourth loop of thread 42 is passed through the continuous bight portions 32 and 38 of loops 24 and 36 respectively and is looped about each of the needle loops 24 of the second thread loops at the upper side of the workpiece 10.

As best seen in FIGS. 2 through 8, one manner of preparing the stitch disclosed in FIG. 1 would be by the use of a machine of the type described hereinabove, that is, a slightly modified Class 39500QW overedge sewing machine manufactured by Union Special Corporation. In preparing the stitch disclosed in FIG. 1, the machine would employ two threaded needle means 50 and 52, one lower thread carrying looper means 54 and one upper thread carrying looper means 56. The machine would have one of said needle means threaded with the thread designated in FIG. 1 by the numeral 18, the remaining needle threaded with the thread designated by the numeral 20, and a unique lower looper means 54 threaded with the thread designated by the numeral 34 while the upper or cover thread looper means 56 is threaded with thread designated by reference numeral 40. It should be pointed out that each of the needle means 50 and 52 is provided with a needle eye means 58 and 60 respectively. However, the eye means 58 of the first needle means 50 is staggered relative the eye means 60 of needle means 52, that is, the needle eye means 60 is disposed a further axial distance from the point 62 of the needle means 52 than is the eye means 58 relative the point means 64 of needle means 50.

Figure 9:
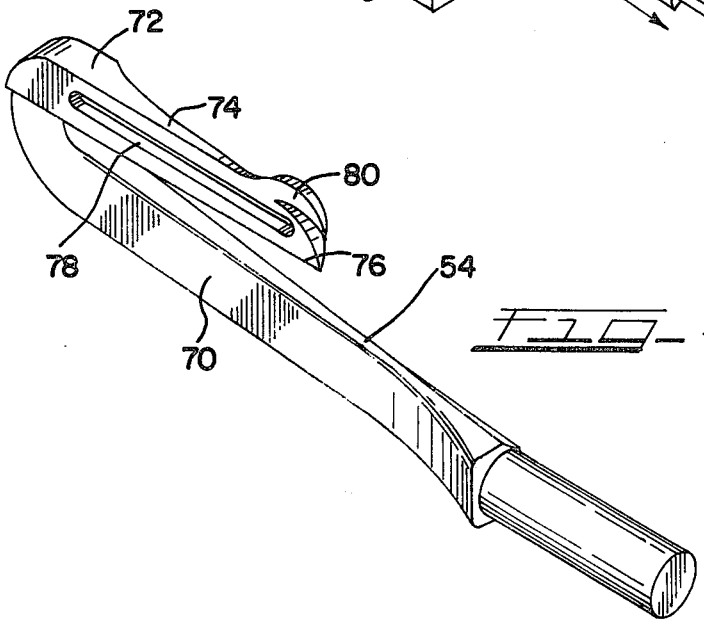
FIG. 9 is a perspective view of the looper and thread maniuplating implement of the present invention.

As is best seen in FIG. 9, the looper means 54 of the present invention, is different from the conventional looper associated with a machine of this sort in that it is comprised of a shank means 70, the free end of which is adapted to be secured in a suitable loop carrier means (not shown) in the same manner as any conventional looper means may be secured therein. The looper means 54 is formed with a butt portion means 72 which extends from its connection with the other end of the shank portion means 70 and joins a blade or loop seizing portion means 74 which terminates at its free extremity in a thread engaging beak means 76. The loop seizing portion means 74 is provided with a thread accomodating groove means 78 along which the looper thread is positioned. The unique feature of this looper is that at the juncture of the blade means 74 and the thread engaging beak means 76, the looper means 54 is formed with or carries a thread manipulating implement or hook means 80 which extends above, and therefore is moveable in a path above the thread engaging beak means 76. The purpose of this hook means will be apparent from the following description.

Figure 2:
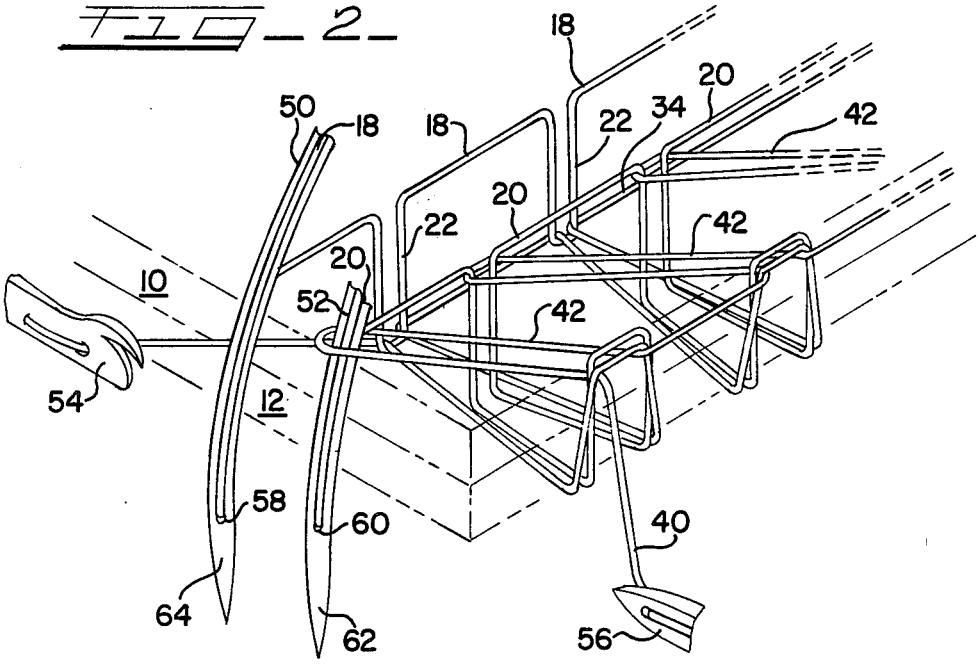
FIGS. 2 through 8 are views corresponding generally to FIG. 1 showing successive steps in the formation of the overedge stitch shown in FIG. 1.

FIGS. 2 through 8 illustrate the operation of the stitch forming mechanism in the formation of the overedge stitch shown in FIG. 1. As shown in FIG. 2, two workpieces 10 and 12 are being sewn by the overedge sewing machine, with a plurality of stitches already having been formed in the workpieces. As illustrated in FIG. 2 the needle means 50 and 52 are at their lowest point of travel, the looper means 54 has already reached its extreme position to the left and is beginning to move in toward the needle means 50 to enter the fabric penetrating loop means 22. The second looper means 56 is at its furthest position to the right whereat the fourth thread loop means 42 is drawn tight about the second needle means 52.

Figure 3:
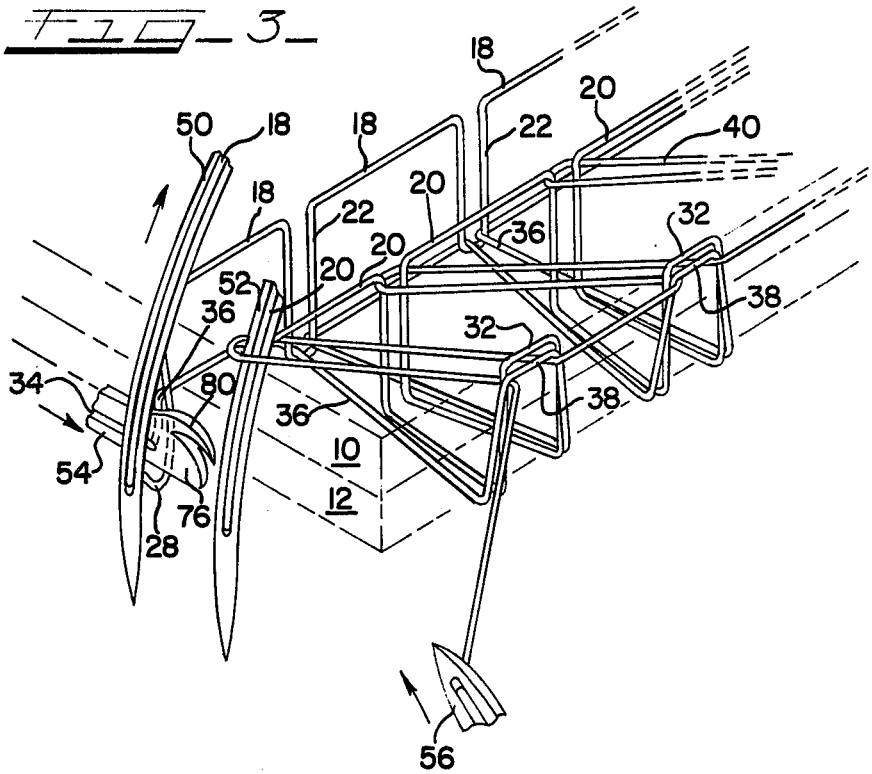

As illustrated in FIG. 3, the needle means 50 and 52 are retiring upward, while the looper means 54, and more particularly the thread engaging beak means 76 and thread manipulating implement or hook means 80 are passing through the bight portion 28 of the first needle thread loop means 22. The advancement of the looper means 54 through the bight portion 28 of the needle loop 22 carries the third loop of thread 36 through the bight portion 28.

Figure 4:
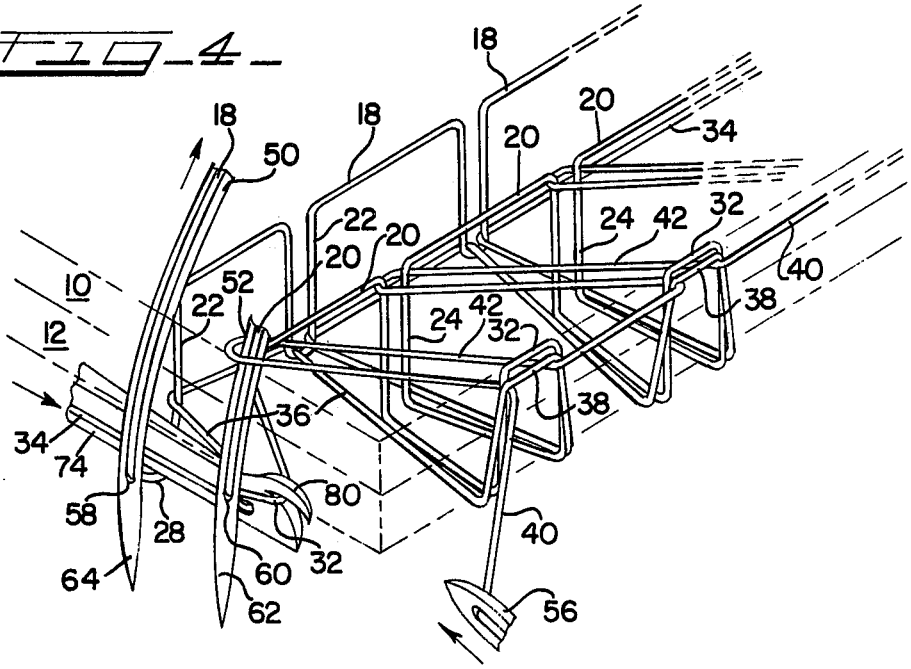

Referring now to FIG. 4, the needle means 50 and 52 continue in their ascent. The looper means 54 continues its advancement to the right, with the loop seizing portion 74 holding the first needle loop means 22 about the looper means 54. The thread manipulating implement means 80 is effective to engage and distend the bight portion 32 of the second thread loop 24 whereby carrying or spreading same beneath the lowermost workpiece. As mentioned above, the axial distance between the needle eye means 60 and the point means 62 of needle means 52 is greater than the corresponding distance on needle means 60. In view of the staggered displacement of the eye means 58 and 60, the bight portion 32 of the second thread loop 24 does not depend from the workpiece a sufficient distance that it lies in the path of movement of the thread engaging beak means 76, but does lie in the direct path of travel of the thread manipulating implement means 80, which as described above is moveable in a path above the thread engaging means 76. The continued advancement of the looper means 54 to the right as viewed in FIG. 4 carries the second and third thread loops 24 and 36 into the position shown in FIG. 5.

Figure 5:
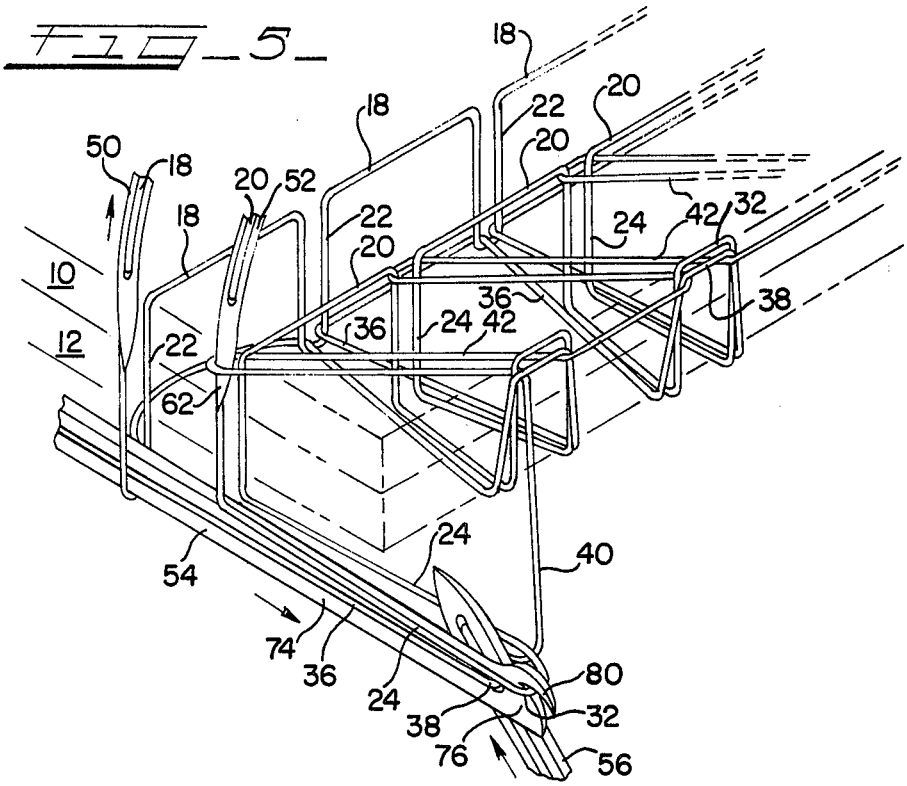

Referring now to FIG. 5, there is shown an advanced stage of the stitch formation shown in FIG. 4, with the first needle loop 22 being more fully drawn up about the loop seizing portion 74 of the looper means 54. The looper means 54 has advanced whereby carrying the bight portion 38 of the third thread loop 36 formed from the looper thread 34 and the bight portion 32 of the second thread loop 24 formed from the upper thread 20 to the edge of the workpieces 10 and 12 for subsequent entry thereinto by the looper means 56. In the formation of the stitch shown in FIG. 1, there are two thread triangles formed. The first or lower triangle is formed by the loop seizing portion means 74 of the looper means 54, the second and third thread loops, 24 and 36 respectively, extending rearwardly from the foremost position shown in FIG. 5 and returning to the previously formed stitch, and the needle thread loop 22 about the loop seizing portion 74 of the looper means 54. It is into this first or lower triangle that the upper looper means 56 travels whereby piercing the contiguous bight portions 32 and 38 with a fourth thread loop 42 formed from the upper or cover thread 40.

Figure 6:
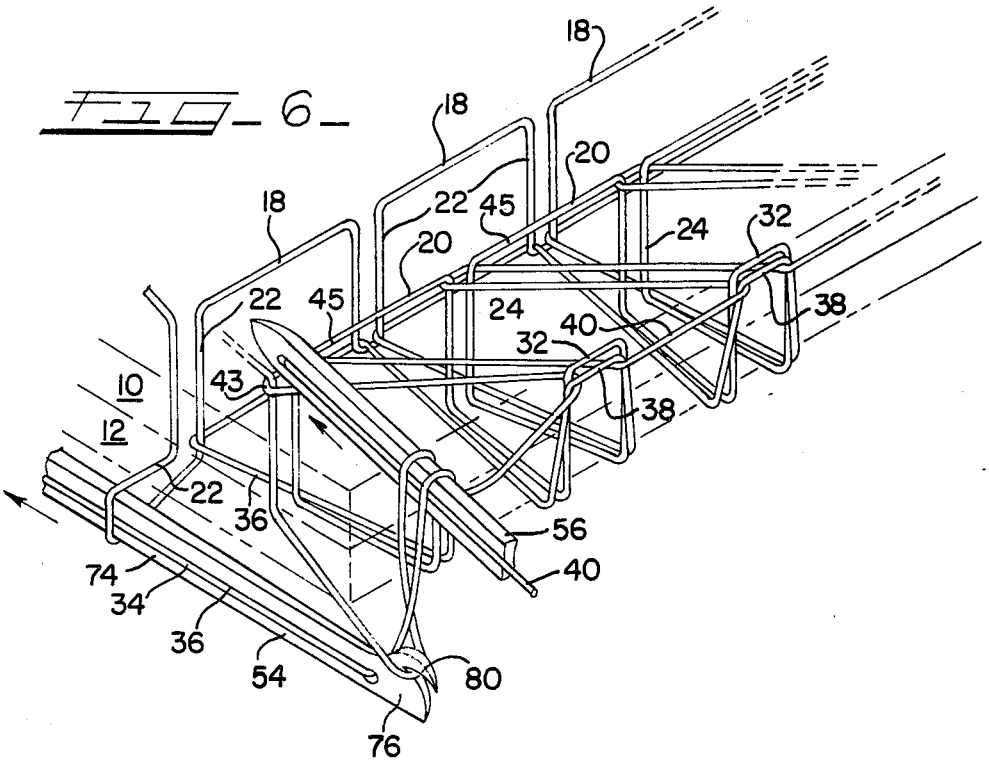

Referring to FIG. 6, the feeding of the material workpieces 10 and 12 has begun and the needles have reached their highest position. The fourth loop of thread 42 and more particularly the bight portion 43 thereof, has been released from the point means 62 of needle means 52 (FIG. 5) and extends around the needle thread loop 24. In so doing, the bight portion 43 of each loop 42 formed from the cover thread 40 is spread between the uppermost surface of workpiece 10 and the adjacent runs 45 of the needle thread 20. The looper means 54 has begun its retirement to the left. The upper looper means 56 has risen into the first triangle and is continuing in its ascent. At this point, it may be noted that the bight portions 32 and 38 of the second and third thread loops are slipping toward the heel (not shown) of the upper looper means 56 and are situated to encompass the fourth thread loop 42 carried by the looper means 56 and formed from the upper or cover thread 40.

Figure 7:
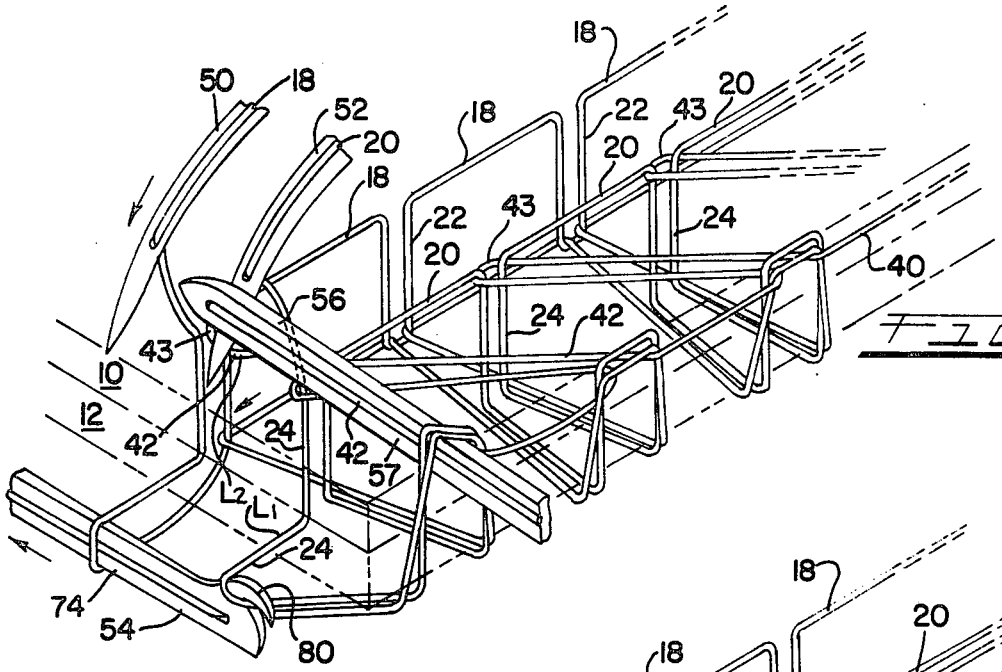

As shown in FIG. 7, the advancement of the workpieces 10 and 12 continues while the needle means 50 and 52 are beginning to descend. The lower looper means 54 continues its retirement to the left and limb L1 of the second needle thread loop 24 is beginning to slide over the thread manipulating implement or hook means 80 in preparation of being drawn taut. The upper looper means 56 has reached its highest point of travel and has brought the fourth thread loop 42 through the contiguous bight portions 32 and 38, of the second and third thread loops 24 and 36 respectively. It is in this position that the bight portion 43 associated with the fourth thread loop 42 is presented to the needle means 52 for subsequent penetration thereby in the usual manner. That is, the needle means 52 enters the upper looper thread loop or second triangle which is created by the blade portion means 57 of the upper looper means 56, a portion L2 of the upper looper or cover thread 40 extending outwardly from the looper means 56 and is connected to the previously formed stitch, and the contiguous bight portion 32 and 38 around the blade portion means 57 of the looper means 56.

Figure 8:
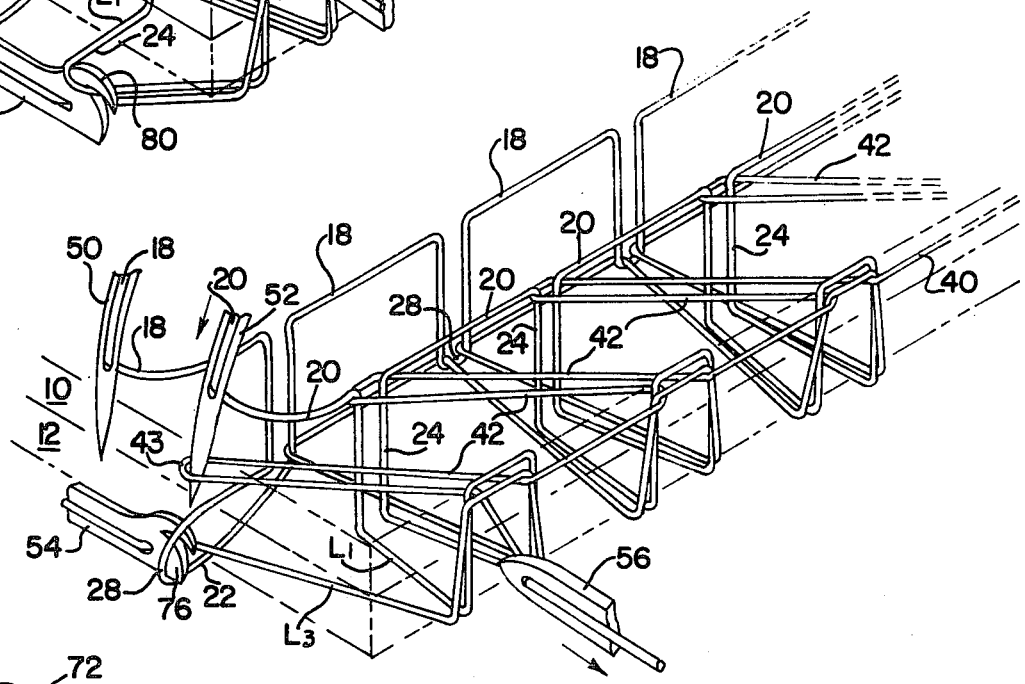

Referring to FIG. 8, the workpieces 10 and 12 have been moved one stitch length and the needle means 50 and 52 are still descending and have now entered the workpieces. The lower looper means 54 is still moving to the left and the limb L1 has slipped over the thread manipulating implement means 80 and has been pulled taut up into the overedge stitch. In view of the retraction of the looper means 54 the first thread loop 22 is slipping off the thread engaging beak means 76 of the looper means 54 while the latter is pulling one limb L3 of the third thread loop 35 formed from the looper thread 34 through the bight portion 28 of the first thread loop 22.

Thus, in accordance with the present invention, there is disclosed an overedge stitch which is formed by penetrating the workpiece to be joined with a first needle thread loop. The first needle thread loop is interlocked on the bottom side of the workpiece with a looper or a lower thread which has been formed into a thread loop by the reciprocatory movements of the looper of the machine. A second needle thread loop is passed through the workpiece at spaced intervals relative the first thread loop. The second needle thread loop is spread beneath the lowermost workpiece by the engaging and distending movement of the hook means and the bight portion thereof is situated along the edge of the uppermost fabric ply. The lower thread, which as mentioned above is formed into a third loop of thread by the reciprocatory movement of the lower looper means is spread around the second loop of thread and the bight portion is located adjacent the bight portion of the second thread loop whereby providing additional coverage along the edge of the workpiece than has been heretofore known. The upper looper thread, formed into a fourth thread loop as a result of the movement of the upper looper means, penetrates contiguous bight portions of the second and third thread loops. The bight portion of the fourth thread loop encircles the runs of the second needle loop at their respective penetration points and completes the formation of the overedge stitch.

The completed stitch of FIGS. 1 through 8 possesses substantially the same characteristics of a stitch known as a Federal Stitch Type 512. However, a distinguishing and advantageous feature of the stitch of the present invention over the Federal Stitch Type 512 is that the second needle thread loop of the present invention is brought around the edge to add better coverage to the edge of the garment and is not tightly pulled up as is the second needle thread loop in the Federal Stitch Type 512. By disposing the second needle thread loop laterally beneath the lower workpiece in a manner such that it is not tightly pulled up into the seam avoidance of the heretofore known puckering problem of the garment workpiece is made possible.

Thus it is apparent that there has been provided, in accordance with the invention, a method and apparatus for forming an overedge stitch that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An overedge stitch comprising;

a pair of upper threads formed into two fabric penetrating thread loops which project through a workpiece at spaced intervals;

a looper thread passing through the bight portion of one of said thread loops and around the bight portion of the other thread loop; and a thread formed into a corresponding thread loop passing through the bight portion of said other thread loop and the bight portion of said looper thread and extending for subsequent penetration by a fabric penetrating thread loop whereby forming an overedge stitch.

2. An overedge stitch for joining two workpieces having their respective edges lying in a parallel overlapped relationship comprising:

a first continuous needle thread formed into a first thread loop passing downwardly through both workpieces at spaced penetration points lying along a line spaced from the edge of said workpieces;

a second continuous needle thread formed into a second thread loop passing downwardly through both workpieces at spaced penetration points lying along a line spaced from the edge of said workpiece, said second thread loop passes laterally beneath and around the lowermost workpiece portion and having a bight located adjacent the edge of the uppermost ply;

a looper thread formed into a third thread loop passing through the bight portion of said first thread loop and around the second thread loop, each loop of said looper thread having a bight portion adjacent said edge of said uppermost workpiece in lateral alignment with the bight portion of a said second thread loop; and a thread formed into a fourth thread loop, said fourth thread loop passing through the bight portion of said second and third thread loop and extends for subsequent penetration by said first thread loop.

3. The method of forming an overedge stitch along a piece of work material which comprises the steps of:

passing a first needle thread through the work material at points spaced along a line to form a first thread loop;

passing a second needle thread through the work material along a line parallel to said first needle thread to form a second thread loop;

passing a first looper thread through said first thread loop and around said second thread loop;

spreading the second thread loop laterally beneath the work material; and interlooping a second looper thread with said second and third thread loops and extending said second looper thread to the point of penetration of said second needle thread whereby forming an overedge stitch.

4. The method of forming an overedge stitch as defined in claim 3 wherein one of said needle threads is interlooped with one thread, and the other needle thread is interlooped with another thread.

* * * * *